US005785088A

United States Patent [19]

Pai

[11] Patent Number: 5,785,088

[45] Date of Patent: Jul. 28, 1998

[54] FIBER PORE STRUCTURE INCORPORATE WITH A V-SHAPED MICRO-GROOVE FOR USE WITH HEAT PIPES

[75] Inventor: Larry Pai, Taipei Hsien, Taiwan

[73] Assignee: Wuh Choung Industrial Co., Ltd., Taipei Hsien, Taiwan

[21] Appl. No.: 852,948

[22] Filed: May 8, 1997

[51] Int. Cl.[6] ..... F28F 13/00

[52] U.S. Cl. ..... 138/38; 138/177; 165/104.26; 165/184

[58] Field of Search ..... 138/38, 177, 178; 165/104.26, 184, 133, 109.1

[56] References Cited

U.S. PATENT DOCUMENTS

| | | | |
|---|---|---|---|
| 3,865,184 | 2/1975 | Grover | 138/38 X |
| 4,044,797 | 8/1977 | Fujie et al. | 138/38 |
| 4,116,266 | 9/1978 | Sawata et al. | 138/38 X |
| 4,118,944 | 10/1978 | Lord et al. | 138/38 X |
| 4,248,179 | 2/1981 | Bonner | 138/38 X |
| 4,402,359 | 9/1983 | Carnavos et al. | 138/38 X |
| 4,549,606 | 10/1985 | Sato et al. | 165/179 |
| 4,715,436 | 12/1987 | Takahashi et al. | 165/133 |
| 4,733,698 | 3/1988 | Sato | 138/38 X |
| 4,759,516 | 7/1988 | Grose | 138/38 X |
| 4,794,983 | 1/1989 | Yoshida et al. | 165/133 X |
| 5,052,476 | 10/1991 | Sukumoda et al. | 165/133 |
| 5,332,034 | 7/1994 | Chiang et al. | 165/184 |
| 5,453,641 | 9/1995 | Munginger et al. | 165/104.26 |
| 5,682,946 | 11/1997 | Schmidt et al. | 165/133 |
| 5,690,167 | 11/1997 | Rieger | 165/133 |

*Primary Examiner*—Patrick F. Brinson
*Attorney, Agent, or Firm*—Rosenberg, Klein & Bilker

[57] ABSTRACT

A pore structure for use in a heat pipe is provided which includes a plurality of longitudinally extended fibers that are gathered together and spirally disposed on an internal wall surface of a heat pipe. Each of the plurality of fibers has at least one longitudinal V-shaped micro-groove formed therein.

1 Claim, 7 Drawing Sheets

FIBER PORE STRUCTURE INCORPORATE WITH A V-SHAPED MICRO-GROOVE FOR USE WITH HEAT PIPES

BACKGROUND OF THE INVENTION

1. Field of the Invention

This invention concerns a structural improvement for a filter having a V-shaped pore structure for use within heat pipes. The primary objective is to configure the multiple fibers formed on the inner walls of heat pipes. Every fiber contains a V-shaped micro-groove. Using the installation of the V-shaped groove, a larger pore cavity structure, a better pore transferring energy, and heat conductivity is achieved. The fiber can also be wound in a spiral shape to facilitate an insertion operation into the pipe. The pore structure clings to the walls inside the heat pipe and will not crack from bending or shaping of the heat pipe.

As illustrated in FIG. 1 and FIG. 2, there are commonly known pore structures for use on the internal walls of a heat pipe. The pore structure is formed of a metal web 2 (as shown in FIG. 1) that provides a pore function, or an elongated rod-shape pore structure 3 (as shown in FIG. 2). The pore structures formed by the metal webs 2 or the fibers 3, transport the working fluid.

However, the commonly known pore structures in prior art are unable to provide a large pore cavity wick, pore transferring energy and a lesser amount of heat conductivity. Prior art pore structures tend to break, or crack during bending or shaping of the heat pipes. They are unable to cling to the internal walls of the thermal pipe, and require the use of a coil spring for stabilization to make the pore structures cling to the inside walls. In addition, the operation of inserting the pore structures into the thermal pipe is not only difficult, and time consuming, but also cost considerably more, and the cost for the pore structures are higher as well.

As a result, deriving from the above factors, the aforementioned commonly known pore structures for heat pipes contain inconveniences and shortcomings, and can be improved upon.

2. Prior Art

This invention concerns an improvement in the form of a V-shaped micro-groove in a fiber pore structure contained inside heat pipes, especially a method providing a larger pore structure, pore transfer energy and heat conductivity. The pore structure also facilitates the insertion operation into the heat pipe, so that it will cling to the side walls of the heat pipe. With the improved V-shaped micro-grooves in the fiber pores, the structure will not crack due to bending or shaping of the heat pipe.

SUMMARY OF THE INVENTION

The primary objective of this invention is to bring forth an improvement in the form of a V-shaped pore structure for use internal to a heat pipe. It is an object of the invention to form a least one V-shaped coaxial micro-groove along each fiber and form a spiral of multiple fibers inside the heat pipe. The insertion procedure of the fibers into the heat pipe is thereby made easier. The spiral pore structure also clings to the heat pipe wall, and does not require the use of an extra spring coil. The spiral shaped pore structure will not crack when the heat pipes are bent or shaped.

DESCRIPTION OF THE PREFERRED EMBODIMENTS

Figure 1:
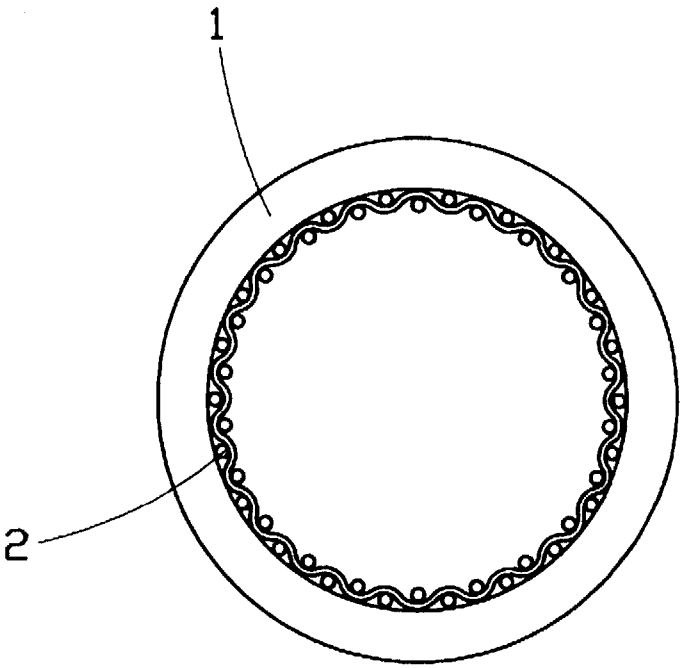
FIG. 1 PRIOR ART
FIG. 1 is an end elevation view of a commonly known pore structure in a heat pipe.
Figure 2:
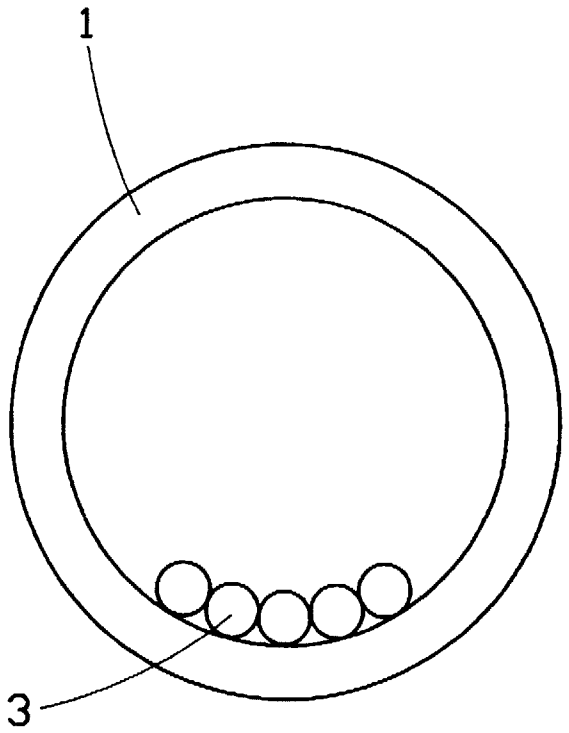
FIG. 2 PRIOR ART
FIG. 2 is an end elevation view of another commonly known pore structure for a heat pipe.
Figure 3:
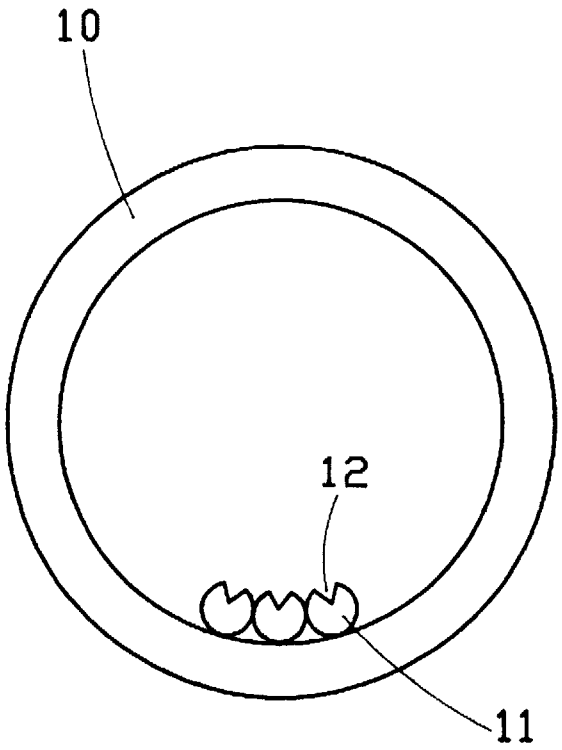
FIG. 3 is an end elevation view of the present invention.
Figure 4:
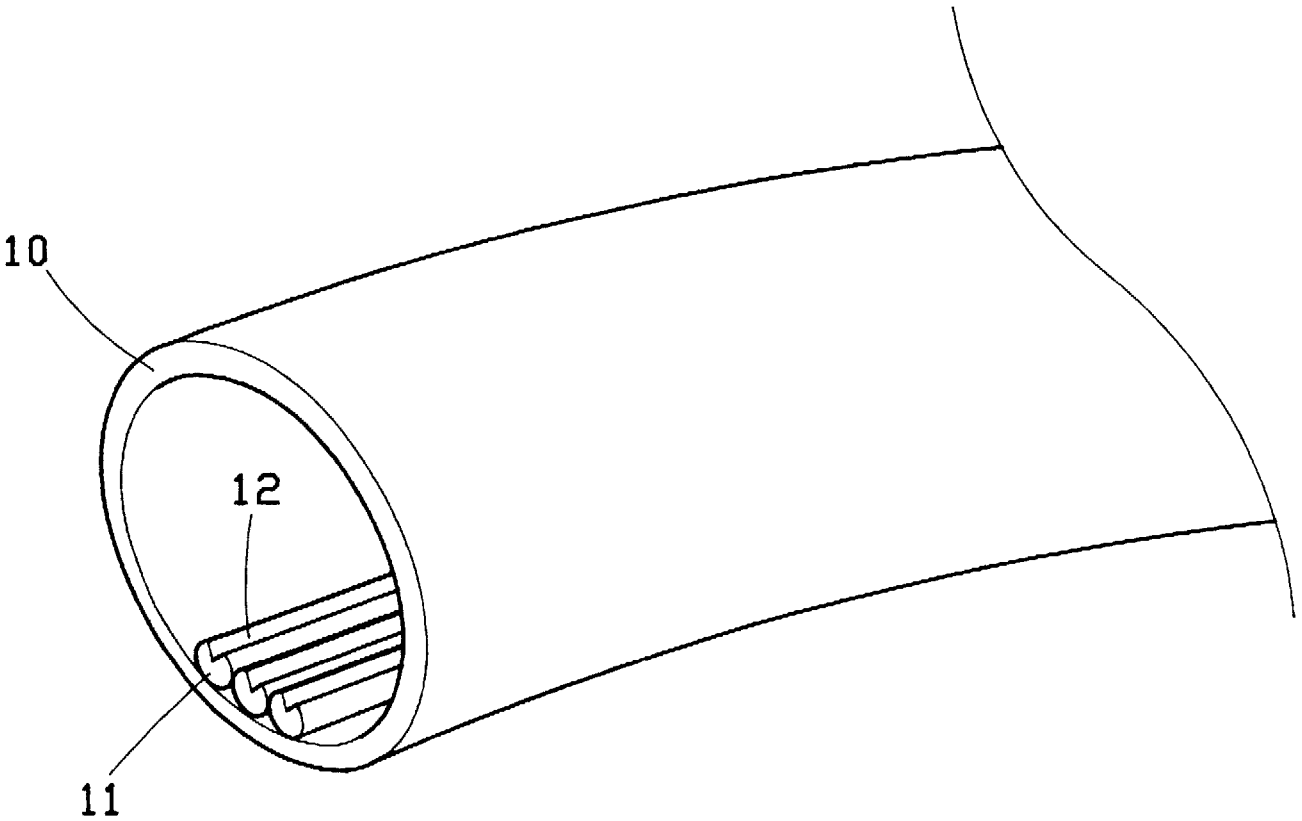
FIG. 4 is a perspective view of the present invention.
Figure 5:
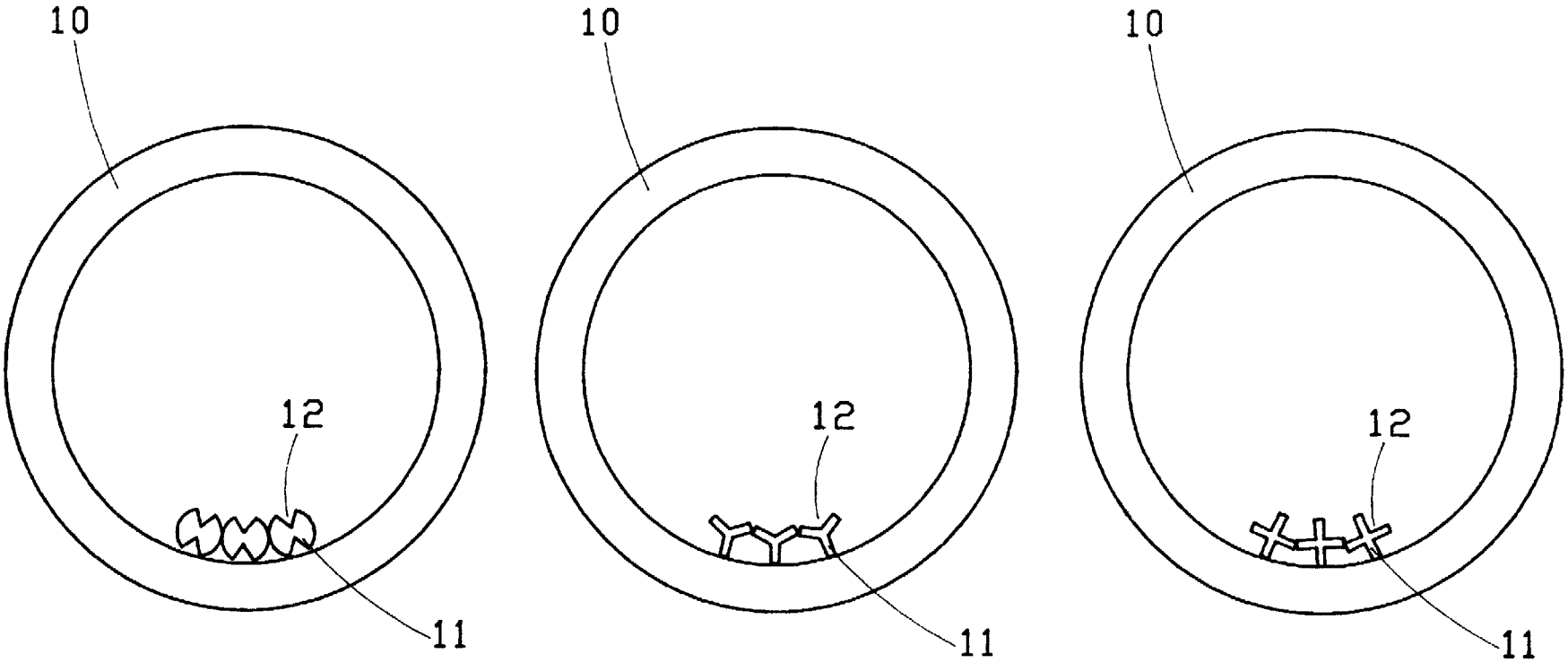
FIG. 5 is an end elevation view of various V-shaped micro-grooves of the present invention.

Referring to FIG. 3 and FIG. 4, an elevation end view and a perspective view of the present invention is shown. The present invention directs itself to a structural improvement for a pored fiber defined by V-shaped micro-grooves for heat pipes. The internal walls of the heat pipe are provided with multiple fibers 11. Each fiber 11 is built with at least one coaxial V-shaped micro-groove 12. Each fiber can be built with one V-shaped micro-groove 12, or with two, three and four V-shaped micro-grooves 12 formed therein, as shown in FIG. 5. The number of V-shaped micro-grooves can be designated in accordance with the diameter of the heat pipe 10.

Figure 6:
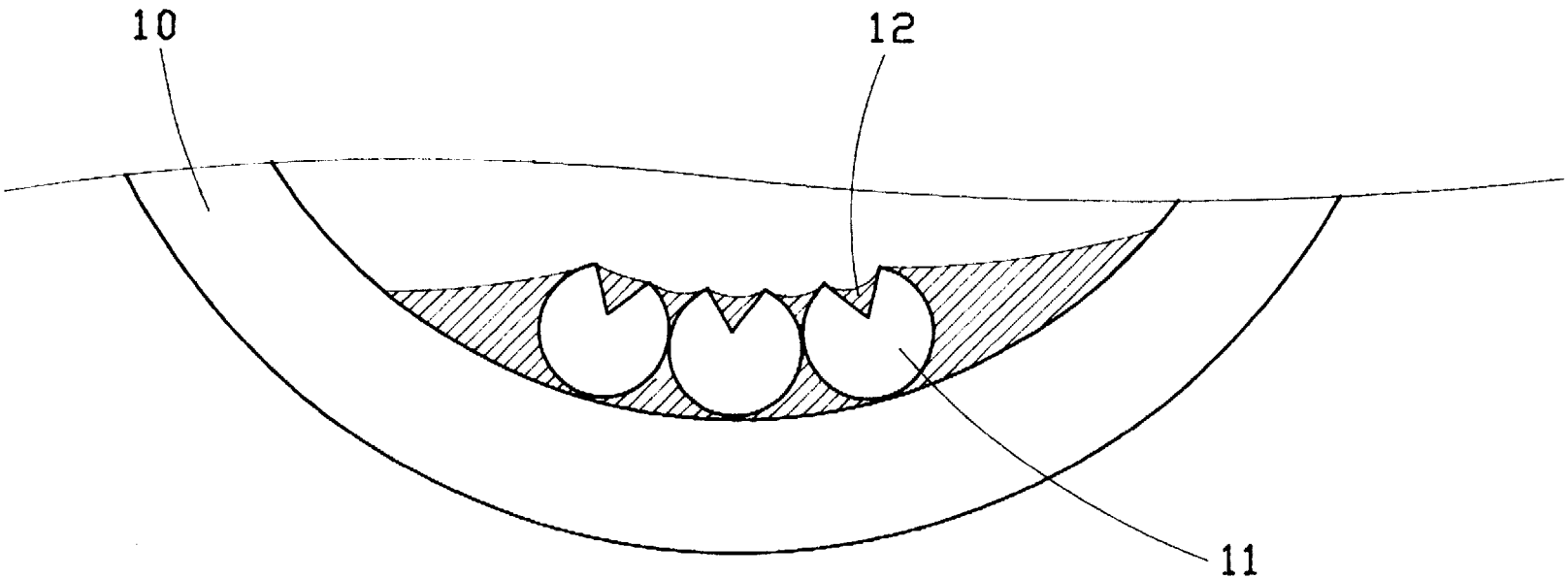
FIG. 6 is an implementation illustration of the present invention.

FIG. 6 illustrates an application of the present invention. The present invention forms V-shaped micro-grooves 12 in the fibers 11 to obtain a larger pore cavity wick, pore transferring energy and heat conductivity. The pore structure will not crack when the heat pipe is bent or shaped and the pore structures are of a relatively low cost.

Figure 7:
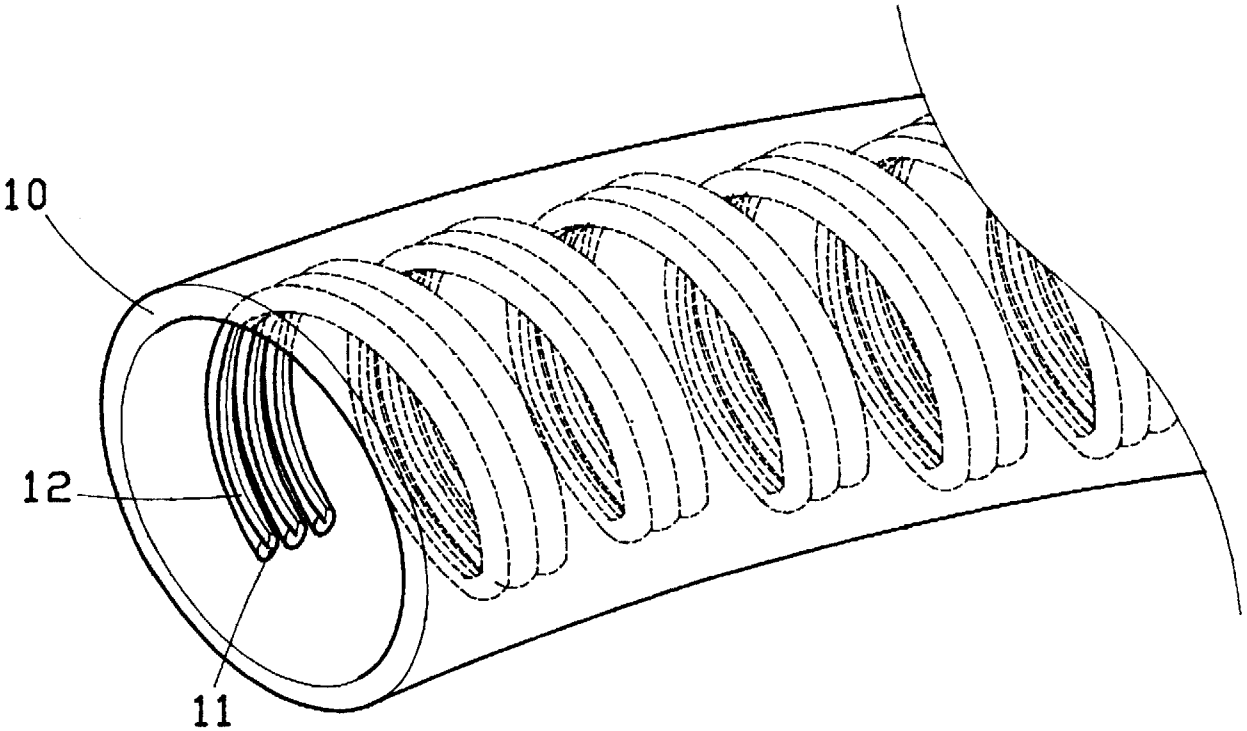
FIG. 7 is a perspective view of another embodiment of the present invention.

Referring to FIG. 7, an illustration of yet another embodiment of the present invention is shown. Within the heat pipe 10 multiple fibers 11 are gathered and formed into a spiral shape. That arrangement facilitates the insertion of fibers into the heat pipe and to stabilize the pore structure's attachment onto the internal walls of the pipe, thus no coil springs are required. The spiral pore structure will not crack due to bending or shaping of the heat pipe 10.

Summarizing, the present invention is an effective improvement to the commonly known pore structures used inside a heat pipe that did not have a large cavity wick, pore transferring energy, good heat conductivity, and resiliency to bending or forming of the pipe. The commonly known pore structures are difficult to cling to the internal wall of the heat pipe, cumbersome in operation, and have a high cost.

The aforementioned structures are some of the better implementations of this invention, but not limiting to its patent coverage. Structural variations associated with this analysis and the illustrations set forth are inclusive in the domain of this invention.

Summarizing the above, the creation is an effective improvement to the commonly known pore structures used inside thermal conductive pipe that did not have large cavity tissue, pore transferring energy, good heat conductivity, and resiliency to bending or forming of the pipe. They are difficult to cling to the internal wall of the thermal pipe, cumbersome to operation, and with a high cost. The invention's unique state-of-the-art features fulfill the new patent application criteria, thus a patent application is filed according to the patent laws to seek patent approval and listing to protect intellectual property rights.

The aforementioned are some of the better implementations of this invention, but not limiting to its patent coverage. Structural variations associated with this analysis and the illustrations set forth are inclusive in the domain of this invention.

I claim:

1. A pore structure for use in a heat pipe comprising a plurality of longitudinally extended fibers gathered together and spirally disposed on an internal wall surface of the heat pipe, each of said plurality of fibers having at least one longitudinal V-shaped micro-groove formed therein.

* * * * *